US005613446A

United States Patent [19]

DiLuigi et al.

[11] Patent Number: 5,613,446

[45] Date of Patent: Mar. 25, 1997

[54] RAILWAY HOPPER CAR GATE VALVE AND OPERATING ASSEMBLY

[75] Inventors: Michael W. DiLuigi; Raymond R. Lund, both of Asheville; Kevin D. Bramlett, Mars Hill, all of N.C.

[73] Assignee: Trinity Industries, Inc., Dallas, Tex.

[21] Appl. No.: 433,311

[22] Filed: May 2, 1995

[51] Int. Cl.[6] ..... B61D 7/20; B61D 7/22; B61D 7/26

[52] U.S. Cl. ..... 105/282.2; 105/282.3; 105/305; 105/310; 222/153.14; 222/561

[58] Field of Search ..... 105/282.1, 282.2, 105/282.3, 305, 308.1, 308.2, 310; 406/130; 298/27; 137/347; 222/153.14, 561

[56] References Cited

U.S. PATENT DOCUMENTS

| | | | |
|---|---|---|---|
| 713,622 | 11/1902 | Enyart . | |
| 1,171,980 | 2/1916 | Rogers . | |
| 1,749,119 | 3/1930 | Wilson . | |
| 2,559,760 | 7/1951 | Dorey | 105/249 |
| 2,589,468 | 3/1952 | Wine | 105/249 |
| 2,591,924 | 4/1952 | Dorey | 29/164 |
| 2,710,017 | 6/1955 | Carter | 137/246.11 |
| 2,712,289 | 7/1955 | Dorey | 105/280 |
| 2,720,173 | 10/1955 | Dorey | 105/280 |
| 2,784,679 | 12/1957 | Wine | 105/280 |
| 2,912,215 | 11/1959 | Forrester | 251/13 |
| 3,047,024 | 7/1962 | Schuller | 138/94.3 |
| 3,082,700 | 3/1963 | Dorey | 105/253 |
| 3,185,435 | 5/1965 | Hauser | 251/158 |
| 3,241,730 | 3/1966 | Dorey | 222/505 |
| 3,276,396 | 10/1966 | Talboys et al. | 105/253 |
| 3,401,645 | 9/1968 | Floehr | 105/253 |
| 3,461,817 | 8/1969 | Farmer | 105/282 |
| 3,650,567 | 3/1972 | Danielson | 302/52 |
| 3,693,846 | 9/1972 | Schuller | 222/506 |
| 3,707,126 | 12/1972 | Nester | 105/282 |
| 3,807,318 | 4/1974 | Chierici | 105/282.2 |
| 3,812,980 | 5/1974 | Kolb et al. | 213/76 |
| 3,826,203 | 7/1974 | Martin et al. | 105/282 |
| 3,827,374 | 8/1974 | Winsor | 105/282.3 |
| 3,828,808 | 8/1974 | Ortelli | 137/340 |
| 3,893,398 | 7/1975 | Fischer | 105/308 |
| 3,912,134 | 10/1975 | Poran | 222/504 |
| 3,956,996 | 5/1976 | Fischer | 105/308 |

(List continued on next page.)

FOREIGN PATENT DOCUMENTS

| | | |
|---|---|---|
| 553807 | 3/1958 | Canada . |
| 53714 | 10/1937 | Denmark . |

OTHER PUBLICATIONS

Brochure, *Miner ® AutoLok—Patented Discharge Gates for Covered Hopper Cars*, W.H. Miner Division, 4 pages, dated 1994.

"Gravac® Gravity–Vacuum Discharge Gate" by Miner Enterprises, Inc., W.H. Miner Division, MEG–007–Aug. 1989 – 2M; © 1989.

"Specification for New Gravity Outlet Gates on Covered Hopper Cars," Association of American Railroads, Mechanical Division, Manual of Standards and Recommended Practices (S–233), pp. C–11 through C–13.4 (Sep. 1, 1992).

*Primary Examiner*—S. Joseph Morano
*Attorney, Agent, or Firm*—Baker & Botts, L.L.P.

[57] ABSTRACT

A gate valve assembly and a frame assembly for mounting the gate valve assembly on the discharge opening from a railway hopper car. The gate valve assembly includes an operating assembly for movement of a valve member within the gate valve assembly between a first, closed position and a second, open position. A locking mechanism is mounted on the frame assembly to maintain the gate valve assembly in its first closed position when the associated railway car is subjected to large impact forces. The operating assembly includes a lock striker which may be moved longitudinally relative to the valve member to deactivate the locking mechanism while the valve member remains in its closed position. The frame assembly also provides an enhanced seal or barrier to prevent materials from escaping when the gate valve assembly is in its closed position.

36 Claims, 5 Drawing Sheets

U.S. PATENT DOCUMENTS

| | | | |
|---|---|---|---|
| 4,027,921 | 6/1977 | Adler et al. | 302/52 |
| 4,036,149 | 7/1977 | White | 105/280 |
| 4,077,552 | 3/1978 | Lothmann | 222/600 |
| 4,103,817 | 8/1978 | Spatig | 228/173 |
| 4,214,536 | 7/1980 | Waddell et al. | 105/282.3 |
| 4,224,879 | 9/1980 | Van Auken | 105/282 |
| 4,250,987 | 2/1981 | Trammell et al. | 198/530 |
| 4,253,400 | 3/1981 | Fischer et al. | 105/282 |
| 4,256,042 | 3/1981 | Fischer | 105/282 |
| 4,317,532 | 3/1982 | Przybylinski | 222/559 |
| 4,452,149 | 6/1984 | LeMarbe | 105/250 |
| 4,454,822 | 6/1984 | Fischer | 105/250 |
| 4,528,913 | 7/1985 | Randolf | 105/282.3 |
| 4,534,298 | 8/1985 | Scott | 105/282 |
| 4,542,701 | 9/1985 | Fischer et al. | 105/240 |
| 4,601,244 | 7/1986 | Fischer | 105/240 |
| 4,617,868 | 10/1986 | Wahlstrom et al. | 105/282 |
| 5,005,490 | 4/1991 | Overheldt | 105/282.2 |
| 5,038,966 | 8/1991 | Olk | 222/504 |
| 5,046,432 | 9/1991 | Bowler | 105/282.1 |
| 5,086,709 | 2/1992 | Fischer et al. | 105/282.1 |
| 5,163,372 | 11/1992 | Galvan et al. | 105/240 |
| 5,272,987 | 12/1993 | Lucas | 105/308 |
| 5,285,811 | 2/1994 | DiLuigi et al. | 137/347 |
| 5,353,713 | 10/1994 | Dohr et al. | 105/310 |
| 5,507,235 | 4/1996 | Dugge et al. | 105/308.2 |

RAILWAY HOPPER CAR GATE VALVE AND OPERATING ASSEMBLY

TECHNICAL FIELD OF THE INVENTION

This invention relates in general to the field of railway hopper cars and gate valves for controlling the discharge of material from hopper cars. More particularly, the present invention relates to a gate valve assembly, operating assembly, frame assembly for mounting the gate valve assembly on a discharge opening, and a locking mechanism which cooperate with each other to substantially enhance the reliability and long term performance of the resulting gate valve assembly.

BACKGROUND OF THE INVENTION

In recent years, pneumatic and vacuum systems have been developed for removing the contents of railway hopper cars having one or more hopper sections. Other systems use rack and pinion assemblies to open and close a gate valve. These systems have generally been designed to operate in conjunction with a gate valve mounted adjacent to the bottom of each hopper section of the railway car to control the discharge of materials from the associated hopper section.

Railway hopper cars often include one or more hopper sections with each hopper section having a discharge opening through which various types of material and/or lading may be discharged by gravity and/or pneumatic pressure. Typically a gate valve assembly including a gate and a frame assembly are mounted on each discharge opening. The gate and frame assembly cooperate with each other to allow longitudinal movement of the gate between a first, closed position and a second, open position to control the discharge of material from the respective hopper section of the railway car.

Railway hopper cars are often subjected to impact forces which can be quite severe. Therefore, it is important to prevent undesired opening of the gate valve assemblies associated with a hopper car. Various types of locking mechanisms have been previously provided to maintain the associated gate valve assembly in its closed position. Examples of such gate valves and locking mechanisms are shown in U.S. Pat. No. 5,353,713. Also, a wide variety of gate valves have previously been used with railway hopper cars. U.S. Pat. No. 5,285,811 provides one example of such gate valve assemblies. Both of these patents are incorporated by reference for all purposes within this application.

Gate valve assemblies associated with railway hopper cars are often subjected to harsh operating conditions and frequent cycling between open and closed positions. Therefore, it is important to provide a reliable seal or material barrier when the gate valve assembly is in its closed position to prevent any undesired leakage of material from the associated railway hopper car. It is also necessary to prevent leakage into the hopper car.

SUMMARY OF THE INVENTION

In accordance with the present invention, disadvantages and problems associated with previous gate valve and frame assemblies used to mount a gate valve on a discharge opening from a railway hopper car have been substantially reduced or eliminated. The present invention provides a gate valve assembly, operating assembly, frame assembly and locking mechanism which prevent undesired opening of the resulting gate valve assembly and substantially enhance the performance of the gate valve assembly in harsh service environments. The gate valve assembly opening force also disengages the locking mechanism. A valve member included with the gate valve assembly in accordance with the teachings of the present invention cooperates with portions of the frame assembly having a gasket to form an enhanced seal or material barrier with the frame assembly when the gate valve assembly is in its closed position. For some applications one end of the valve member or gate may be folded to provide a very stiff, strong gate suitable for frequent cycling from its closed positions to its open position while subjected to heavy loads. For other applications one end of the valve member or gate may include an angle iron to provide a very stiff, strong gate suitable for frequent cycling from its closed position to its open position while subjected to heavy loads.

One aspect of the present invention includes a frame assembly which may be used to mount a gate valve assembly on a discharge opening from a railway hopper car. Typically, the gate valve assembly will include a valve member or gate having a configuration to generally match the discharge opening associated with the railway hopper car. An automatic locking mechanism is provided to prevent accidental movement of the gate valve assembly from its closed position to its open position when the railway car is subjected to heavy impact loads. The frame assembly may also include a gasket-type seal disposed on the periphery of the associated discharge opening to form a material barrier when the associated gate valve assembly is in its closed position.

Technical advantages of the present invention include providing a frame assembly which may be easily mounted on the discharge opening from a railway car. The present invention also provides a locking mechanism having a hook which cooperates with a tapered surface formed on one end of a valve member to provide adequate resistance to undesired movement of the valve member when the associated railway car is subjected to impact forces and tapered surfaces formed on one end of a lock striker which require application of only a relatively low amount of force by an operating assembly to move the locking mechanism to a position allowing opening of the associated gate valve assembly. An adjusting mechanism is provided to allow varying the position of the locking mechanism with respect to the valve member to assist in maintaining the valve member in its closed position except when the operating assembly is used to move the valve member from its closed position to its open position.

Additional technical advantages of the present invention include a gasket having a generally rectangular configuration with a generally trapezoidal cross section and a hollow passageway formed therein. For some applications, relatively stiff reinforcing rods are preferably disposed in the hollow passageway extending along the perimeter of the gasket to provide the desired rectangular configuration. One side of the gasket may have two or more rods disposed within the hollow passageway and aligned longitudinally with respect to each other to provide limited flexibility for expansion of the gasket while installing the gasket around the periphery of the associated discharge opening. A plurality of gasket retainers are preferably provided for use in installation and removal of the gasket and to adjust the position of the gasket relative to the closed position of the associated valve member.

A further aspect of the present invention includes providing a frame assembly which allows installation of a gasket around the periphery of the associated discharge opening and provides supporting surfaces to allow both vertical and longitudinal movement of the associated valve member relative to the gasket during movement of the valve member between its open and closed position. Also, the various components associated with the gate valve assembly and the frame assembly are constructed in accordance with the teachings of the present invention to substantially minimize or eliminate any locations which could possibly trap grain or other material being discharged through the respective gate valve assembly. The teachings of the present invention result in substantially reducing the manufacturing costs associated with, a gate valve assembly, frame assembly, operating assembly and locking mechanism used to control the discharge of material from a railway hopper car. The teachings of the present invention also substantially increase the service life of the resulting gate valve assembly and reduce the costs associated with maintenance and repair of the resulting gate valve assembly.

Other technical advantages of the present invention include no additional action is required to unlock the gate valve assembly other than normal opening action associated with the gate valve assembly. Cooperation between the operating assembly and the locking mechanism results in a savings of time and a decrease in the likelihood of injury to a person operating the associated gate valve assembly. An operating assembly and lock mechanism incorporating the teachings of the present invention cooperate with each other to prevent damage to the gate valve assembly if the locking mechanism is not properly disengaged before opening forces are applied to the associated gate valve.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

The preferred embodiments of the present invention and its advantages are best understood by referring to FIGS. 1 through 15 of the drawings, like numerals being used for like and corresponding parts of the various drawings.

Figure 1:
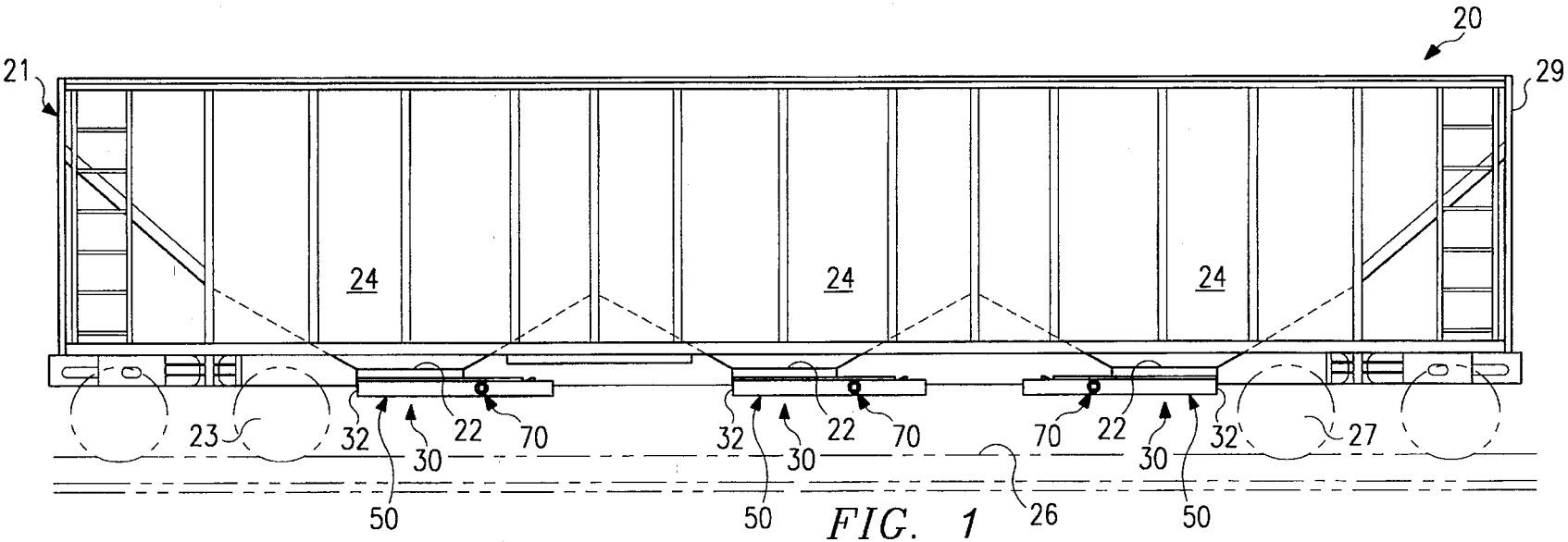
FIG. 1 is an elevational view of a railway hopper car having a plurality of discharge openings with a gate valve assembly incorporating teachings of the present invention mounted on each discharge opening.
Figure 15:
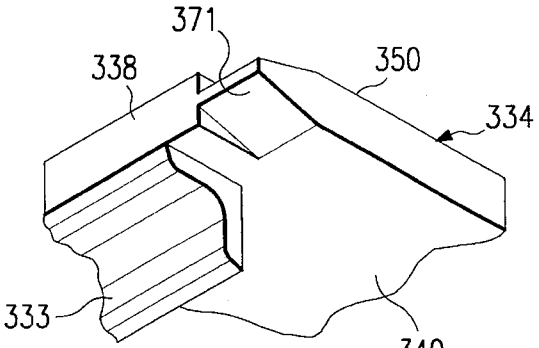
FIG. 15 is a schematic drawing with portions broken away showing the front end of a valve member or gate satisfactory for use with the gate valve assembly of FIG. 14.

Railway hopper car 20 is shown in FIG. 1 having three gate valve assemblies 30 constructed in accordance with the teachings of the present invention mounted respectively on discharge openings 22 from each hopper section 24 of railway hopper car 20. For the embodiment shown in FIG. 1, railway hopper car 20 includes three funnel-like hopper sections 24 and three discharge openings 22. A gate valve assembly incorporating teachings of the present invention may be used with a wide variety of railway hopper cars or any other container with an appropriate discharge opening for a mounting the gate valve assembly thereon.

Various types of material and lading including grain, cement, sand, and sugar may be transported within railway hopper car 20. Gate valve assembly 30 is provided to control the discharge of such material from the respective hopper section 24. As will be described later in more detail, the present invention provides operating assembly 70 having locking mechanism 110 to ensure that the associated gate valve assembly 30 remains in its closed position even though railway hopper car 20 may be subjected to substantial impact or shock loads associated with coupling adjacent railway cars and movement of railway hopper car 20 on rails 26 as part of a long train (not shown).

The present invention allows gate valve assembly 30, frame assembly 50, operating assembly 70, and locking mechanism 110 to comply with various requirements of the Grain Elevator And Processing Society (GEAPS) for loading, unloading and hauling grain. The teachings of the present invention result in substantially reducing manufacturing costs, increasing reliable operation and minimizing potential malfunctions of the resulting gate valve assembly.

The present invention also results in increased service life for a railway hopper car with the gate valve assembly while reducing both the cost and time required to perform repair and/or maintenance on the gate valve assembly. Gate valve assembly 30 and frame assembly 50 may be fabricated in accordance with the teachings of the present invention to meet the requirements of the Association of American Railroads (AAR) Specification S233.

Gate valve assemblies 30 incorporating the teachings of the present invention may be installed with various orientations. For purposes of explanation, end 21 may be referred to as the B end or the brake end of railway car 20. As shown in FIG. 1, two gate valve assemblies 30 are oriented with their respective front end 32 facing end 21. Front end 32 of the third gate valve assembly 30 faces end 29 or the A-end of railway hopper car 20.

Installing gate valve assemblies 30 as shown in FIG. 1 results in longitudinal alignment of the associated valve members or gates 34 with the center sill (not shown) of railway hopper car 20. Also, the orientation of gate valve assemblies 30 as shown in FIG. 1 results in the respective frame assemblies 50 and operating assemblies 70 being directed away from railway trucks 23 and 27 at respective ends 21 and 29 of railway hopper car 20. This orientation prevents interference between the respective frame assembly 50 and trucks 23 and 27. Also, the orientation shown in FIG. 1 positions each operating assembly 70 for easy access from either side of railway hopper car 20. As will be discussed later in more detail, valve member 34 of each gate valve assembly 30 typically slides longitudinally with respect to the center sill of railway hopper car 20.

Schematic representations of various portions of gate valve assembly 30, frame assembly 50, operating assembly 70 and locking mechanism 110 incorporating teachings of the present invention are shown in FIGS. 2–10. Frame assembly 50 is used to mount the associated gate valve assembly 30 on the respective discharge opening 22. Operating assembly 70 is provided to move valve member 34 of gate valve assembly 30 between its first, closed position and its second, open position. Locking mechanism 110 is provided to prevent inadvertent or accidental movement of valve member 34 from its closed position to its open position as a result of impact loads on railway hopper car 20.

Figure 2:
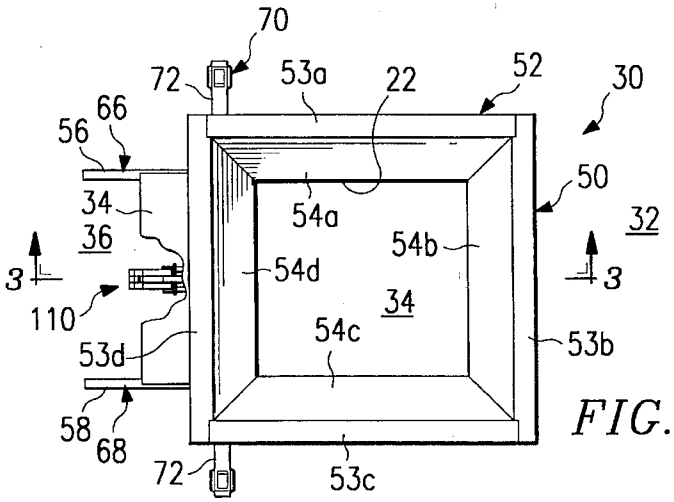
FIG. 2 is a schematic drawing with portions broken away showing a plan view of a gate valve assembly with an operating assembly, locking mechanism and frame assembly incorporating one embodiment of the present invention.
Figure 3:
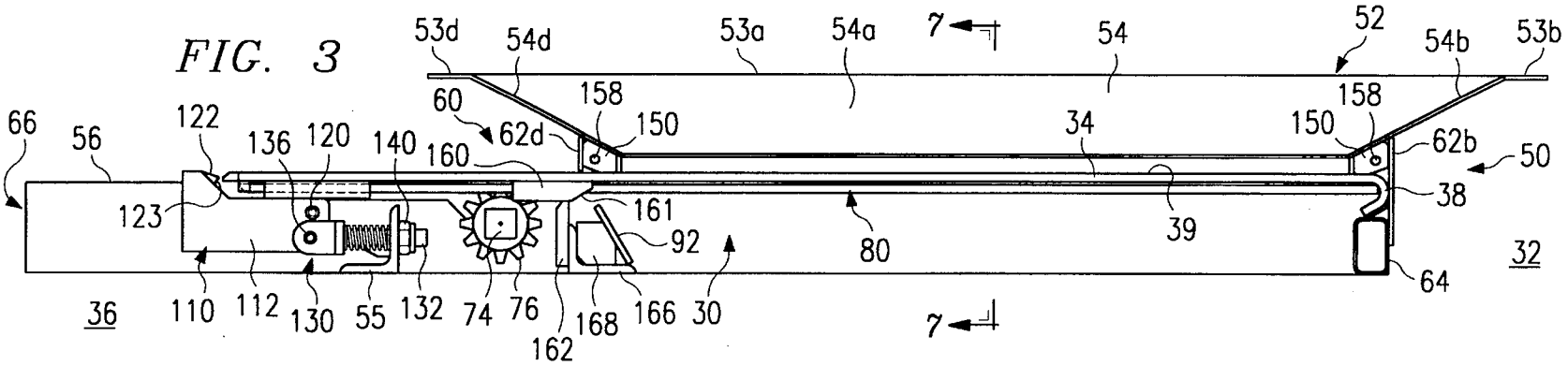
FIG. 3 is a schematic drawing in section with portions broken away showing the gate valve assembly of FIG. 2 taken along lines 3—3.
Figure 4:
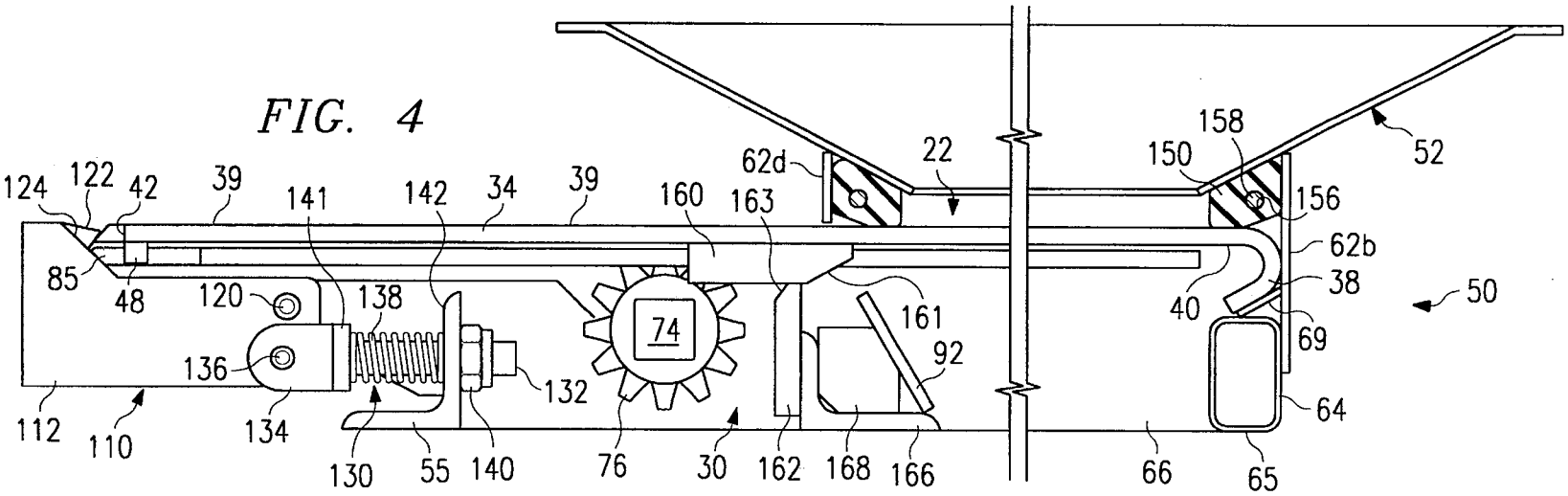
FIG. 4 is a schematic drawing in section with portions broken away showing the gate valve assembly of FIG. 3 with the lock striker contacting the locking mechanism to move the locking mechanism from its first position to its second position.

As shown in FIG. 2, frame assembly 50 and portions of gate valve assembly 30 including valve member 34 have a generally rectangular configuration. In FIGS. 2, 3 and 4 gate valve assembly 30 is shown in its closed position which corresponds with the first position of valve member 34. Operating assembly 70 is provided to move gate valve member 34 between its first position and its second position which corresponds with the open position for gate valve 30 allowing discharge of material from the respective hopper section 24.

Frame assembly 50 includes upper hopper portion 52 having a generally rectangular perimeter defined in part by four relatively flat flange surfaces 53*a, b, c* and *d* which are aligned with each other in a horizontal plane to facilitate mounting frame assembly 50 and its associated gate valve assembly 30 with the respective hopper section 24. The dimensions of each flange surface 53 may be varied as required for the respective hopper section 24. Flange surfaces 53*a, b, c* and *d* may be mounted on the respective hopper section 24 by various techniques including welding and/or appropriately sized nuts and bolts (not shown).

Upper hopper portion 52 also includes a plurality of generally flat surfaces 54*a, b, c* and *d* extending inwardly from the respective flange surfaces 53*a, b, c* and *d* to further define discharge opening 22. Again, the dimensions of flange surfaces 53*a, b, c* and *d*, surfaces 54*a, b, c* and *d* and the resulting discharge opening 22 may be varied as desired to accommodate the respective hopper section 24. For the specific embodiment shown in FIG. 2, discharge opening 22 has a generally rectangular configuration defined in part by the adjacent ends of surfaces 54*a, b, c* and *d*.

The portions of operating assembly 70 shown in FIG. 2 include capstans 72 which extend laterally from each side of frame assembly 50 to allow opening and closing of the respective gate valve assembly 30 from either side of railway hopper car 20. A pair of capstans 72 are rotatably mounted on each frame assembly 50 and attached to a respective operating shaft 74 to allow conventional equipment such as an opening bar to move the respective gate valve assembly 30 between its first, closed position and its second, open position. As shown in FIGS. 3, 4, 5 and 9, each operating shaft 74 preferably has a generally square cross section to fit within a portion of each capstans 72 such that rotation of either capstans 72 will result in rotation of the respective operating shaft 74.

A pair of tracks 56 and 58 are shown in FIG. 2 extending longitudinally from frame assembly 50 at back-end 36 of the respective valve assembly 30. As will be explained later in more detail, operating assembly 70 may be used to move valve member 34 longitudinally between its first position and its second position along tracks 56 and 58. Locking mechanism 110 is preferably mounted on frame assembly 50 between tracks 56 and 58. Operating assembly 70 and locking mechanism 110 are also preferably mounted adjacent to back-end 36 of each gate valve assembly 30.

Tracks 56 and 58 are disposed on opposite sides of discharge opening 22 in upper hopper portion 52 and aligned generally parallel with each other to allow operating assembly 70 to move valve member 34 longitudinally between its first position blocking discharge opening 22 and its second position allowing material contained within the respective hopper section 24 to flow through discharge opening 22. For the specific embodiment shown in FIGS. 3–5, discharge opening 22 has a generally rectangular configuration. However, a gate valve assembly incorporating the teachings of the present invention may be satisfactorily used with a discharge opening having various configurations including circular, oval, square, etc.

One or more hold-down bars (not shown) may be provided by the respective frame assembly 50 at the back-end 36 of each gate valve assembly 30. Hold-down bars are used to maintain the desired contact between valve member 34 and tracks 56 and 58 when the respective gate valve assembly 30 is in its open position. The hold-down bars also maintain the desired engagement between operating assembly 70 and valve member 34. The use of such hold-down bars is well known in the art to facilitate the installation and removal of a valve member from its respective gate valve assembly.

As shown in FIGS. 3–7, frame assembly 50 preferably includes upper hopper portion 52 with mainframe 60 attached thereto and extending therefrom. Valve member 34 is slidably disposed within mainframe 60 for movement between its first position which blocks the discharge or flow of material from opening 22 and its second position which allows material to flow through opening 22. Upper hopper portion 52 and mainframe 60 are securely connected with each other by a plurality of supporting member 62 attached to and extending from the exterior of upper hopper portion 52. In FIGS. 3–7 supporting members 62 are represented as plate 62*a* which extend longitudinally along one side of gate valve assembly 30, plate 62*b* which extends laterally across front-end 32 of gate valve assembly 30, plate 62*d* which extends laterally across back-end 36 of gate valve assembly 30 and a plate (not shown) similar to plate 62*a* which extends longitudinally along the other side of gate valve assembly 30. Supporting members 62 may be attached respectively with upper hopper portion 52 using appropriate welding and/or metal-forming techniques.

Mainframe 60 includes hollow tube 64 which extends laterally across front-end 32 of valve assembly 30. One end of supporting member 62*b* is attached to upper hopper portion 52. The other end of supporting member 62*b* is attached to hollow tube 64. A pair of elongated hollow tubes 66 and 68 are attached respectively with upper hopper portion 52 by supporting member 62*a* and a similar supporting member (not shown). Hollow tubes 66 and 68 extend longitudinally from the back-end 36 of gate valve assembly 30. The respective upper surfaces of hollow tubes 66 and 68 provide tracks 56 and 58 for longitudinal movement of valve member 34 relative to discharge opening 22.

The present invention allows selecting various types of hollow tubes for use in fabricating mainframe 60. For the specific example shown in FIGS. 3–7, hollow tubes 64, 66 and 68 have a generally rectangular cross section. The use of such metal tubes reduces manufacturing costs while at the same time improving the overall performance and reliability of the resulting gate valve assembly 30. The dimensions of hollow tubes 64, 66 and 68 may be varied to accommodate various types of unloading terminals (not shown). For example, the dimensions of hollow tubes 64 and 66 may be varied to provide respective lower surfaces 65 and 67 with the appropriate width and vertical spacing to substantially minimize or eliminate any loss of material during transfer from the respective hopper section 24 through discharge opening 22 and into the unloading terminal. The lower surfaces on hollow tubes 64, 66 and 68 cooperate with each other to form a very flat, uniform surface around the perimeter of the respective gate valve assembly 30 facing the unloading terminal.

As shown in FIGS. 3–6 and FIG. 9 valve member or gate 34 has a generally elongated rectangular configuration. For some applications valve member 34 may be formed in part from a generally flat rectangular metal plate. End 38 of valve member 34 may be folded with a generally c-shaped configuration. When valve member 34 is in its first position, end 38 is located adjacent to front-end 32 of gate valve assembly 30. The c-shaped configuration of end 38 cooperates with stop 92 to limit the longitudinal movement of valve member 34 from its first position to its second position. As will be discussed later in more detail with respect to gate valve member 334 shown in FIGS. 14 and 15, for some applications it may be preferable to replace the c-shaped configuration of end 34 with transverse angle iron 333.

Figure 6:
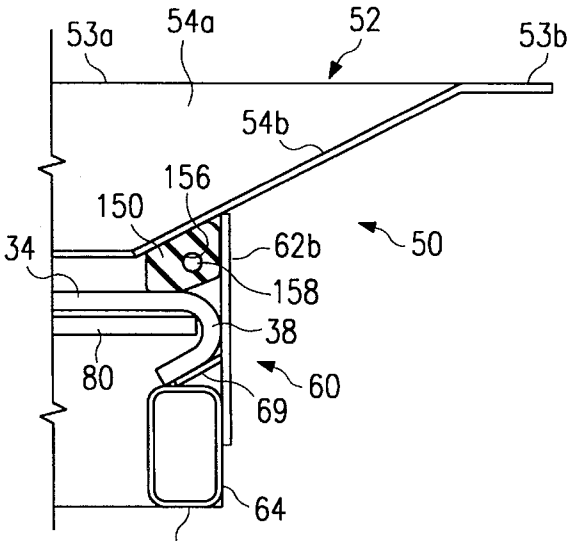
FIG. 6 is a drawing in section with portions broken away showing the front end of the gate valve assembly of FIG. 3.

The c-shaped configuration of end 38 performs several important functions, including providing increased strength and stiffness for valve member 34 when subjected to heavy loads from material contained in the respective hopper section 24. End 38 cooperates with supporting member 62*b* to provide a stop to limit longitudinal movement of valve member 34 from its second position to its first position as shown in FIGS. 3, 4 and 6. Metal strip 69 is preferably disposed laterally along the top of hollow tube 64 at an acute angle relative to the inside surface of supporting member 62*b*. As will be explained later in more detail, metal strip 69 cooperates with end 38 to displace valve member 34 vertically relative to gasket 150. The orientation of metal strip 69 on the upper surface of hollow tube 64 also prevents the build-up of grain or any other material on top of hollow tube 64 during the discharge of such material through opening 22.

As previously noted, each operating assembly 70 includes capstans 72 which may be used to rotate the respective operating shaft 74. A pair of pinion gears 76 and 78 are preferably mounted on operating shaft 74 spaced laterally from each other and disposed beneath valve member 34. Operating assembly 70 also includes lock striker 80 which is slidably disposed on valve member 34. Pinion gears 76 and 78 have an appropriately sized opening with a generally square configuration corresponding to the exterior of operating shaft 74. Pinion gears 76 and 78 are mounted on operating shaft 74 such that any rotation of the respective operating shaft 74 results in rotation of pinion gears 76 and 78 without any lost motion between operating shaft 74 and its associated pinion gears 76 and 78.

Figure 8:
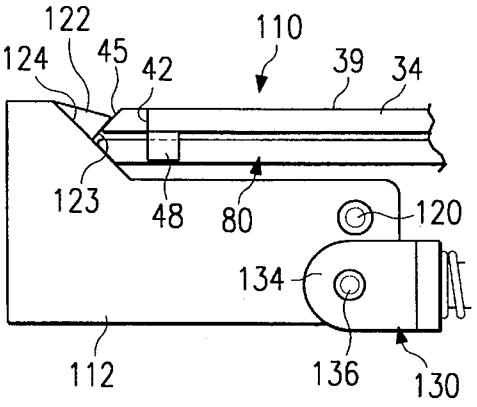
FIG. 8 is a drawing in elevation and in section with portion broken away showing a locking mechanism engaged with one end of a valve member in accordance with the teachings of the present invention.
Figure 9:
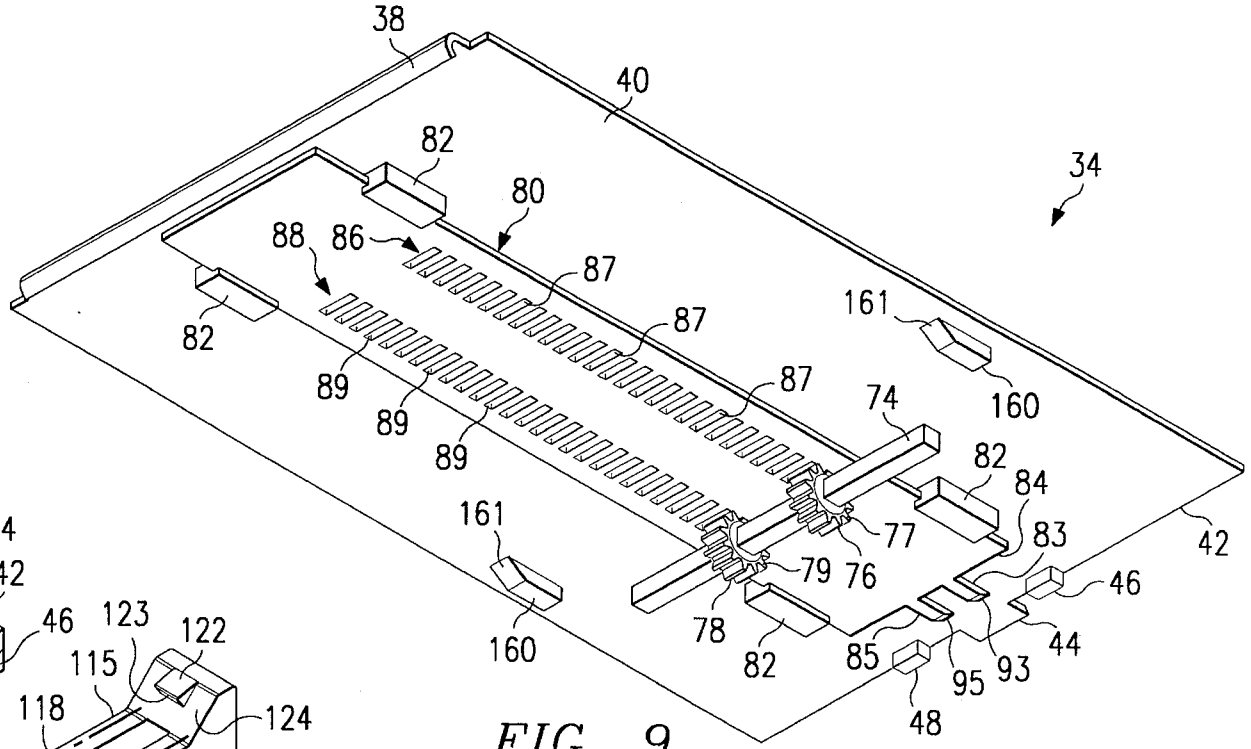
FIG. 9 is an isometric drawing showing an elongated valve member or gate and an operating assembly with portions broken away incorporating one embodiment of the present invention for use with the gate valve assembly of FIG. 3.
Figure 10:
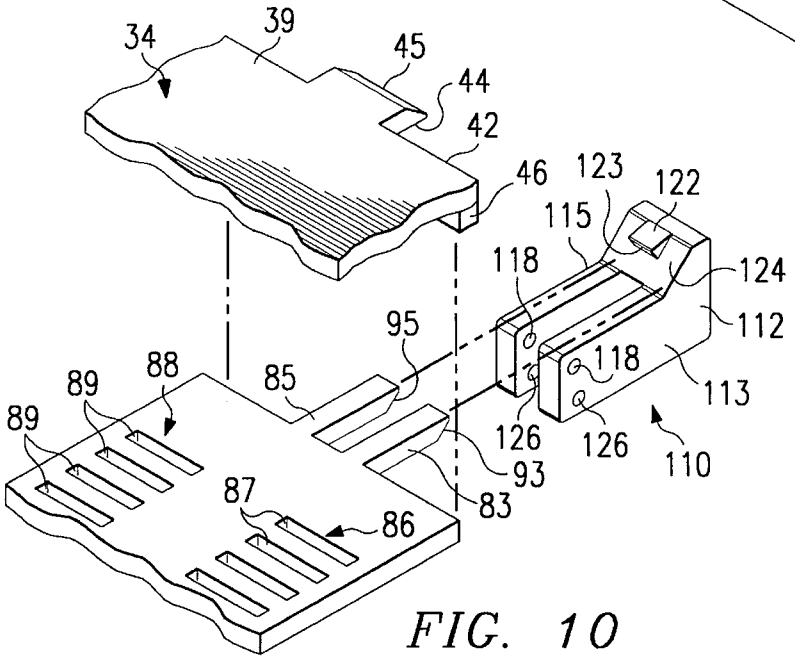
FIG. 10 is an exploded isometric drawing with portions broken away showing a locking mechanism, lock striker, and elongated valve member for use with the gate valve assembly of FIG. 3.

For the specific embodiment of the present invention shown in FIGS. 3–10, valve member 34 includes upper surface 39 and lower surface 40. As best shown in FIG. 9 a plurality of guides 82 are disposed on lower surface 40 of valve member 34 with lock striker 80 slidably disposed therein. Guides 82 cooperate with each other to maintain the desired alignment of tracks 86 and 88 formed in lock striker 80 with respective pinion gears 76 and 78. Tracks 86 and 88 comprise respectively a plurality of slots 87 and 88 which are sized to receive respectively teeth 77 on pinion gear 76 and teeth 79 on pinion gear 78. Lock striker 80 could also be described as a "slidable rack" which cooperates with respective pinion gears 76 and 78 to move the associated valve member 34.

A first stop and a second stop are preferably carried by valve member 34 spaced longitudinally from each other to limit the longitudinal movement of lock striker 80 within guides 82 relative to valve member 34. For the specific embodiment shown in FIG. 9, the first stop is provided by end 38 of valve member 34. The second stop is provided by a pair of blocks 46 and 48 attached to lower surface 40 at back-end 42 of valve member 34. First stop or end 38 limits movement of lock striker 80 away from locking mechanism 110. Second stop or blocks 46 and 48 limit movement of lock striker 80 towards locking mechanism 110. The length of each lock striker 80 is preferably less than its associated valve member 34 to allow limited longitudinal movement of lock striker 80 between the first stop and the second stop. As shown in FIG. 3, when gate valve assembly 30 is in its closed position with valve member 34 in its first position, end 38 of valve member 34 preferably contacts supporting member 62*b* and front end of lock striker 80 contacts end 38.

Locking mechanism 110, as shown in FIGS. 3, 4, 5, 8 and 10, preferably includes body member 112 having at least one portion pivotally attached with frame assembly 50 between tracks 56 and 58. For the specific embodiment shown in FIGS. 3, 4, 5, 8 and 10, body member 112 includes a pair of arms 113 and 115 spaced from each other with hole 118 extending respectively through one portion of each arm 113 and 115. Holes 118 are sized to receive pivot pin 120 to allow attachment of body member 112 with frame assembly 50.

Figure 5:
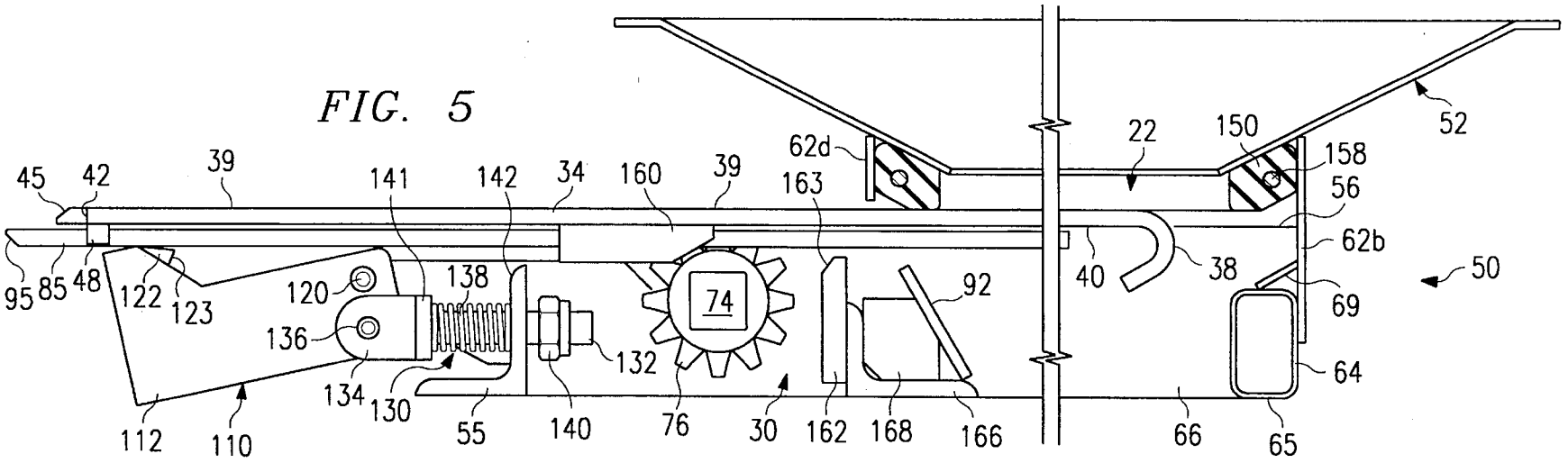
FIG. 5 is a schematic drawing in section with portions broken away showing the gate valve assembly of FIG. 3 with the locking mechanism in its second position and the gate valve assembly intermediate its first, closed position and second, open position.

Locking mechanism 110 is preferably attached to frame assembly 50 having a first position as shown in FIGS. 3, 4 and 8 which blocks movement of valve member 34 from its first position to its second position. Locking mechanism 110 also has a second position as shown in FIG. 5 which allows movement of valve member 34 from its first position to its second position. Hook 122 extends from surface 124 of body member 112 for engagement with back-end 42 of valve member 34 when locking mechanism 110 is in its first position.

For the specific embodiment shown in FIGS. 3, 4, 5, 8, 9 and 10, back-end 42 of valve member 34 preferably includes a configuration for engagement with hook 122 of locking mechanism 110. For this specific embodiment hook 122 preferably includes surface 123 with a rake angle of approximately one hundred degrees (100°) relative to the adjacent surface 124 of body member 112. Back-end 42 of valve member 34 preferably includes lip 44, extending therefrom with tapered nose 45 for engagement with locking mechanism 110. For this specific embodiment, tapered nose 45 preferably extends at an angle of approximately forty-five (45°) relative to upper surface 39 of valve member 34. These angles may be varied in accordance with the teachings of the present invention to provide the desired amount of resistance to prevent movement of valve member 34 from its first position to its second position when railway hopper car 20 is subjected to heavy impact loads.

As shown in FIG. 5, body member 112 of locking mechanism 110 must be rotated with respect to pivot pin 120 to allow opening of valve member 34. The angle or bevel of surface 123 is preferably selected to ensure that the force component normal to surface 123 will pass on the spring side of pivot pin 120. If the angle of surface 123 is changed such that the force component normal to surface 123 passes through pivot pin 120 or on the side of pivot pin 120 opposite from springs 138, impact forces on surface 123 will tend to rotate locking mechanism 110 to its second position. Therefore, the geometric relationship and dimensions associated with pivot pin 120 and pivot pin 136 must be carefully considered in selecting the angle of surface 123.

As previously noted, lock striker 80 is slidably disposed on lower surface 40 of valve member 34 as part of operating assembly 70. Back-end 84 of lock striker 80 preferably includes a pair of prongs 83 and 85 extending longitudinally therefrom and spaced laterally from each other. For the specific embodiment shown in FIGS. 9 and 10, the dimensions and spacing associated with prongs 83 and 85 is preferably selected to correspond respectively with similar dimensions for arms 113 and 115. The extreme end of each prong 83 and 85 preferably includes respective tapered surfaces 93 and 95 which correspond approximately with tapered surface 124 of body member 112. Thus, lock striker 80 may be extended longitudinally from back-end 42 of valve member 34 to rotate locking mechanism 110 from its first position to its second position prior to operating assembly 70 moving valve member 34 from its first, closed position to its second, open position.

The angle or bevel associated with surfaces 123 and 124 performs an important function. If valve member 34 moves against locking mechanism 110, surfaces 123 and 124 (See FIGS. 8 and 10) cooperate with each other to provide a wedge preventing movement of locking mechanism 110 even if valve member 34 contacts locking mechanism 110 with substantial force. Even though locking mechanism 110 can hold against such substantial force, valve member 34 is easily moved to its open position by operating assembly 70. Tapered surfaces 93 and 95 of lock striker 80 function as an inclined plane to easily move locking mechanism 110 to its second position.

Blocks 46 and 48 are preferably offset laterally from each other to allow prongs 83 and 85 to extend longitudinally therebetween. The dimensions associated with tapered surfaces 93 and 95 are selected for engagement with and movement of locking mechanism 110 from its first position to its second position. The amount of force which operating assembly 70 must apply to rotate locking mechanism 110 may be varied by adjusting the angles associated with tapered surfaces 93, 95 and 124.

For one application locking mechanism 110 satisfactorily held against approximately a two thousand pound or 10G impact load. For this same application, approximately as little as fifty foot pounds (50 ft.lbs.) of torque applied to operating assembly 70 was sufficient to move locking mechanism 110 from its first position to its second position and approximately two hundred to two hundred and fifty foot pounds (200–250 ft.lbs.) of torque was required to open valve member 34.

Locking mechanism 110 preferably includes biasing means 130 for urging locking mechanism 110 to move from its second position to its first position and to yieldable hold locking mechanism 110 in its first position. For the specific embodiment shown in FIGS. 3, 4, 5, 8 and 10, biasing means 130 preferably includes a pair of rods 132 with end 134 of each rod 132 pivotally attached to body member 112. Arms 113 and 115 include holes 126 which are offset from respective holes 118 for use in pivotally attaching end 134 of the respective rod 132. For the specific example shown in FIGS. 3, 4, 5, 8 and 10, pivot pin 136 may be inserted through the respective ends 134 and holes 126 to attach each rod 132 with its respective arm 113 and 115.

As best shown in FIGS. 3, 4 and 5, frame assembly 50 may include angle iron 55 extending laterally between hollow tubes 66 and 68. A portion of each rod 132 is slidably engaged within an appropriately sized opening (not shown) provided in angle iron 55. Spring 138 is disposed on the exterior of each rod 132 between first shoulder 141 on the exterior of rod 132 and second shoulder 142 provided on frame assembly 50 by angle iron 55. The number of springs 138 and their associated spring rate determine in part the amount of force required to rotate locking mechanism 110 from its first position to its second position. Springs 138 also function to hold latching mechanism 110 from its first position unless the required amount of opening force has been applied by operating assembly 70. For some applications, it may be desirable to install only a single rod 132 and a single spring 138. For other applications, it may be desirable to use more than two rods 132 with respective springs 138.

An important benefit of the present invention includes the ability to vary the amount of force required to rotate locking mechanism 110 from its first position to its second position by changing the number of springs depending upon the intended use of the resulting gate valve assembly 30 and the various forces which may be placed on valve member 34. For some applications, springs 138 are preferably selected such that if one spring 138 should fail, the other spring 138 will still provide sufficient force to return locking mechanism 110 from its second position to its first position.

Since pivot pin 136 associated with biasing means 130 is offset from pivot pin 120, springs 138 urge movement of locking mechanism 110 from its second position as shown in FIG. 5 to its first position as shown in FIGS. 3, 4 and 8. The exterior of each rod 132 is preferably threaded (not shown) to allow placing nut 140 on the end of each rod 132 extending through angle iron 55. Nuts 140 may be used to adjust the vertical position of hook 122 relative to lip 44 and tapered nose 45 on back-end 42 of the associated valve member 34.

Another important feature of the present invention includes gasket 150 disposed on the exterior of each upper hopper portion 52 between the respective supporting members 62 and the surfaces 54*a, b, c* and *d* around the perimeter of each discharge opening 22. For the specific embodiment shown in FIGS. 3–7, 11 and 14, gasket 150 has a generally rectangular configuration with opening 152 extending therethrough. Perimeter 154 of opening 152 is selected to be slightly larger than the perimeter of discharge opening 22 defined by the respective upper hopper portion 52.

As shown in FIGS. 3–7, gasket 150 has a generally trapezoidal cross section with bore 156 formed therein and extending longitudinally along each side of gasket 150. The trapezoidal cross section is required for some applications to allow removal of an old gasket 150 and installation of a new gasket 150. A plurality of reinforcing members 158 are preferably disposed within each longitudinal bore 156 extending longitudinally along each side of gasket 150. For one application, reinforcing members 158 may be formed from metal rods having an outside diameter corresponding approximately with the inside diameter of the respective longitudinal bore 156. For other applications, reinforcing members 158 may be formed from various types of metal and/or composite materials.

Figure 11:
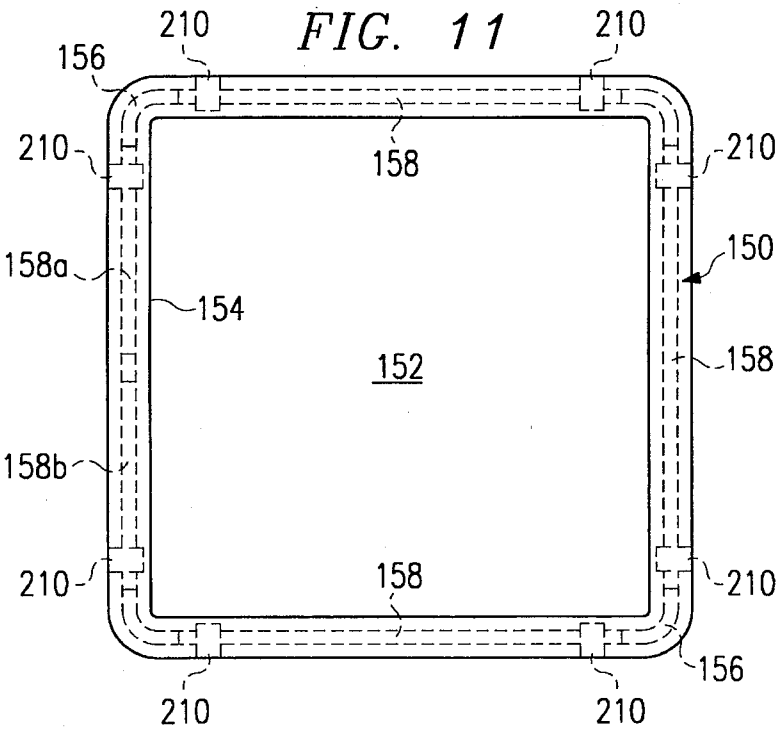
FIG. 11 is a schematic plan view of a gasket incorporating teachings of the present invention for use with a gate valve assembly.
Figure 12:
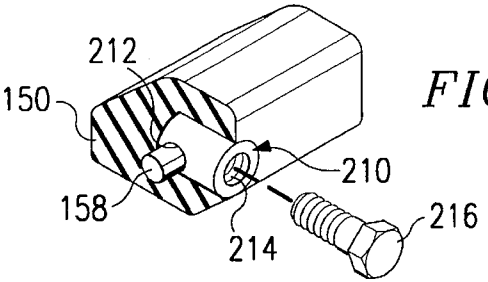
FIG. 12 is an isometric drawing with portions broken away of a gasket retainer satisfactory for use with the gasket of FIG. 11.

As shown in FIGS. 11 and 12, a plurality of gasket retainers 210 are preferably included as part of gasket 150. A plurality of holes may be formed in gasket 150 to accept the associated gasket retainer 210. As shown in FIG. 11, gasket retainers 210 are preferably included along each side of the associated gasket 150. Each gasket retainer 210 preferably includes an opening 212 sized to accept the associated reinforcing member 158. Gasket retainers 210 are installed in gasket 150 with their respective openings 212 aligned with bore 156. Each gasket retainer 210 also includes threaded opening 214 which is disposed generally perpendicular to the associated opening 212 and sized to receive retainer bolt 216. Appropriately sized holes or slots (not shown) are preferably provided in each supporting member 62*a, b, c* and *d* to receive bolts 216 and to hold gasket 150 in the desired location relative to opening 22. The size of these slots (not shown) is preferably large enough to allow vertical adjustment of the position of gasket 150 with respect to valve member 34 to establish the desired material barrier when valve member 34 is in its closed position. Retainer bolts 216 and the trapezoidal cross section of gasket 150 allow replacement if the respective gasket 150 becomes damaged or worn.

For some applications, one side of gasket 150 may include two or more reinforcing members 158*a* and 158*b*. By providing two or more reinforcing member 158*a* and 158*b* along one side, gasket 150 may be stretched or expanded to facilitate installation on the exterior of the respective upper hopper portion 52.

For some applications, gasket 150 may be formed from close cell foam type material. For other applications, gasket 150 may be formed from elastomeric material selected for compatibility with the material carried in the respective hopper sections 24. An important feature of the present invention includes fabricating gasket 150 and reinforcing members 158 from materials which are compatible with each other and the intended use of railway hopper car 20 to provide the desired material barrier when the respective gate valve assembly 30 is in its closed position. Also, forming gaskets 150 in accordance with the teachings of the present invention will increase the service life of railway hopper car 20 between required maintenance for gate valve assemblies 30.

As shown in FIGS. 3–7, gasket 150 may be disposed within frame assembly 50 around the periphery of discharge opening 22. Upper surface 39 of valve member 34 preferably has a relatively flat, smooth surface for tight, sealing engagement with gasket 150. At least one set of ramps 160 and 162 are disposed respectively on valve member 34 and frame assembly 50 for positioning upper surface 39 of valve member 34 in contact with gasket 150 when valve member 34 is in its first position. Ramps 160 and 162 also cooperate with each other to allow displacement of upper surface 39 of valve member 34 away from gasket 150 as valve member 34 moves longitudinally from its first position to its second position. Ramps 160 and 162 may have various configurations. For the embodiment shown in FIGS. 3, 4 and 5, ramps 160 and 162 cooperate with each other to minimize any tendency for weight applied to valve member 34 by material in the respective hopper section 24 to open the associated gate valve assembly 30.

For the specific embodiment of the present invention shown in FIGS. 3–6, end 38 of valve member 34 also cooperates with metal strip 69 on frame assembly 50 to further enhance the material barrier formed between gasket 150 and upper surface 39 of valve member 34 when gate valve assembly 30 is in its closed position. The dimensions associated with ramps 160 and 162 including respective tapered surfaces 161 and 163 along with the dimensions of end 38 and strip 69 determine the amount of compression placed on gasket 150 as valve member 34 moves from its second position to its first position. An important feature of the present invention includes the ability to vary the dimensions associated with ramps 160 and 162 along with end 38 to provided a very close, tight seal between each gasket 150 and the adjacent portions of the respective upper surface 39.

As best shown in FIG. 5, when valve member 34 moves longitudinally from its first position to its second position, ramps 160 and 162 along with end 38 and strip 69 cooperate with each other to allow vertical displacement of upper surface 39 away from the respective gasket 150. Such vertical displacement eliminates high pressure contact between upper surface 39 and gasket 150 as valve member 34 moves longitudinally between its first position and its second position which substantially increases the service life associated with gasket 150 and the respective gate valve assembly 30.

For the specific embodiment of the present invention shown in FIGS. 3, 4, 5 and 9, valve member 34 preferably includes a pair of ramps 160 disposed on opposite sides of lower surface 40. Each ramp 160 is spaced inwardly from the respective longitudinal edge of valve member 34 to accommodate respectively tracks 56 and 58. The distance between ramps 160 and the respective longitudinal edge of valve member 34 corresponds approximately to the width of respective hollow tubes 66 and 68.

Angle iron 166 is preferably attached to and extends laterally between hollow tubes 66 and 68. Ramps 162 are mounted on one side of angle iron 166. For the specific embodiment shown in FIGS. 3–5, block 168 is attached with the opposite side of angle iron 166 with stop 92 mounted thereon. Thus, angle iron 166 is used to connect both stop 92 and ramps 162 with frame assembly 50.

The normal opening and closing sequence for gate valve assembly 30 will generally include the following steps. An appropriately sized opening tool (not shown) is engaged with capstan 72. The opening tool may be either manual or power operated. Rotation of capstan 72 directly rotates operating shaft 74 and pinion gears 76 and 78 with no lost motion. Such rotation is translated by tracks 86 and 88 into longitudinal movement of lock striker 80 relative to valve member 34. For one application, lock striker 80 will initially move approximately one and one-half inches. During this initial movement, prongs 83 and 84 will contact surface 124 and move locking mechanism 110 from its first position as shown in FIG. 4 to its second position as shown in FIG. 5. Back-end 84 of lock striker 80, will next contact second stops 46 and 48 to start movement of valve member 34 from its closed position to its open position. Further rotation of operating shaft 74 will move both lock striker 80 and valve member 34 longitudinally in unison until C-shaped end 38 contacts second stop 92.

Rotation of capstan 72 in the opposite direction will result in operating shaft 74 and pinion gears 76 and 78 moving valve member 34 longitudinally from its second position to its first position. As end 38 contacts metal strip 69 and tapered surfaces 161 on ramps 60 contacts tapered surfaces 163 on the associated ramps 162, valve member 34 will be displaced vertically towards gasket 150. This vertical displacement of valve member 34 results in compression of gasket 150 to provide the desired material barrier. Longitudinal movement of valve member 34 continues until end 38 contacts supporting member **62*b***.

Figure 7:
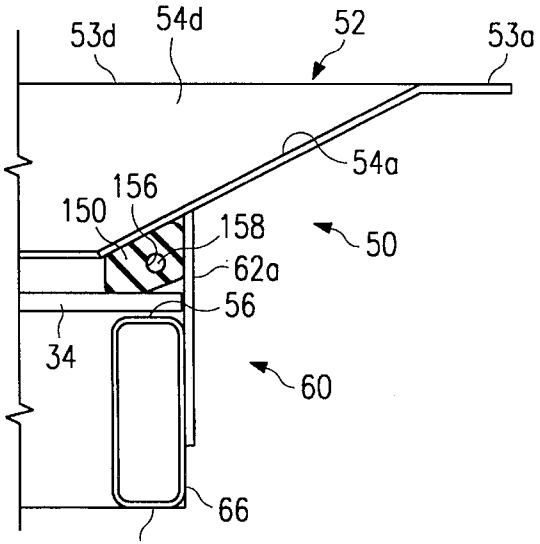
FIG. 7 is a drawing in section with portions broken away taken along lines 7—7 of FIG. 3.
Figure 13:
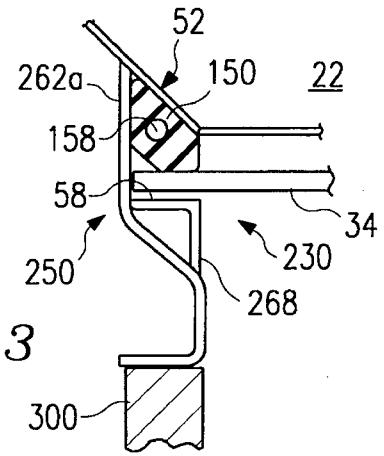
FIG. 13 is a schematic drawing in section with portions broken away showing a gate valve assembly and frame assembly incorporating an alternative embodiment of the present invention.

Portions of gate valve assembly 230 and frame assembly 250 incorporating an alternative embodiment of the present invention are shown in FIG. 13. Frame assembly 250 may include upper hopper portion 52 as previously described. In a similar manner, gate valve assembly 230 may include valve member 34 as previously described. The portion of gate valve assembly 230 and frame assembly 250, shown in FIG. 13, corresponds approximately with the portion of valve assembly 30 and frame assembly 50 as shown in FIG. 7.

Supporting member **262*a* is attached to upper hopper portion 52 as previously described. Gasket 150 is preferably disposed on the exterior of upper hopper portion 52 around the perimeter of discharge opening 22. The lower portion of supporting member 262*a* has a generally "S" shaped cross section. Angle iron 268 is preferably welded with the interior of supporting member 262*a* and extends longitudinally from gate valve assembly 230. A similar supporting member and angle iron would be provided on the opposite side of discharge opening 22. The upper surface of angle iron 268 provides track 58 and the similar angle iron (not shown) provides track 56. Thus, a pair of angle irons may be attached to supporting members 262 on opposite sides of discharge opening 22, with each angle iron providing an upper surface corresponding respectively to tracks 56 and 58 to allow longitudinal movement of valve member 34 between its first and second position. A portion of unloading terminal 300 is shown in FIG. 13 disposed adjacent to and in close proximity with the lower surface of supporting member 262*a***.

Figure 14:
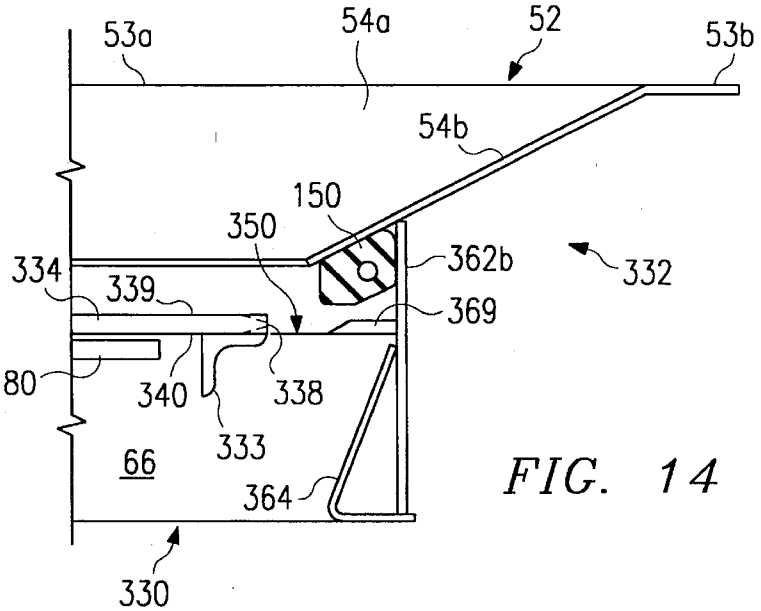
FIG. 14 is a schematic drawing in section with portions broken away showing the front end of a gate valve assembly and frame assembly incorporating a further embodiment of the present invention.

Portions of gate valve assembly 330 and frame assembly 350 incorporating a further embodiment of the present invention are shown in FIG. 14. Frame assembly 350 may include upper hopper portion 52 as previously described. In a similar manner, gate valve assembly 330 may include operating assembly 70 and locking mechanism 110 as previously described. The portions of gate valve assembly 330 and frame assembly 350, shown in FIG. 14, corresponds approximately with the portions of gate valve assembly 30 and frame assembly 50 as shown in FIG. 6.

Valve member or gate 334 has a generally elongated rectangular configuration similar to valve member 34 except for modifications at end 338. Angle iron 333 is welded transversely across bottom surface 340 adjacent to end 338 to provide support in the same manner as the generally C-shaped configuration at end 38 of valve member 34. Angle iron 333 also reacts with lock striker 80 to move valve member 334 from its second, open position to its first, closed position. Angle iron 333 also reacts with stop 92 to limit the longitudinal movement of valve member 334 from its first position to its second position.

Front end 332 of gate valve assembly 330 has been further modified by replacing hollow tube 64 with a strip of formed sheet metal 364. Spacers 369 are preferably welded on top of each tube 66 and 68 adjacent to supporting member **362*b* to function as a ramp with respect to end 338 of valve member 334. For some applications it may be desirable to provide tapered surfaces 371 on each side of valve member 334 at end 338 to improve the interaction with the respective ramps 369. See FIG. 15. The dimensions of end 338 and ramps 369 are selected to provide the desired contact between upper surface 339 and gasket 150 when valve member 334 is in its closed position. The relatively flat surface on the top of each ramp 369 cooperates with bottom surface 340 to prevent the weight of material in the associated hopper section 24 from applying force in a direction to move valve member 334 to its open position. Lock striker 80 will contact angle iron 333 to move valve member 334 to its closed position in the same manner that lock striker 80 engaged end 38 of valve member 34**.

Although the present invention and its advantages have been described in detail, it should be understood that various changes, substitutions and alterations can be made without departing from the spirit and scope of invention as defined by the following claims.

What is claimed is:

1. A gate valve assembly to control discharging material from an opening comprising:

a frame assembly for mounting the gate valve assembly with the opening;

a valve member slidably disposed within the frame assembly for movement between a first, closed position blocking the discharge of material from the opening and a second, open position allowing material to flow through the opening;

an operating assembly disposed on the frame assembly for moving the valve member longitudinally between its first position and its second position;

a locking mechanism attached to the frame assembly having a first position which blocks movement of the valve member from its first position to its second position and a second position which allows movement of the valve member from its first position to its second position; and a lock striker slidably disposed on the valve member as part of the operating assembly whereby the lock striker may be extended longitudinally from the valve member to move the locking mechanism from its first position to its second position prior to the operating assembly moving the valve member from its first, closed position to its second, open position.

2. The gate valve assembly of claim 1 wherein the valve member further comprises:

a generally rectangular plate having an upper surface and a lower surface;

a plurality of guides disposed on the lower surface of the rectangular plate with a portion of the lock striker slidably disposed within the guides for longitudinal movement of the lock striker relative to the rectangular plate; and one end of the rectangular plate having a configuration for engagement with the locking mechanism.

3. The gate valve assembly of claim 1 further comprising:

a gasket disposed within the frame assembly around the periphery of the opening;

the valve member having a first, relatively flat surface for engagement with the gasket;

at least one set of ramps disposed respectively on the valve member and the frame assembly for positioning the first surface of the valve member in contact with the gasket when the valve member is in its first position; and the ramps cooperating with each other to allow displacement of the first surface of the valve member from the gasket as the valve member moves longitudinally from its first position to its second position.

4. The gate valve assembly of claim 1 further comprising:

a gasket disposed within the frame assembly around the periphery of the opening;

the valve member having a surface for engagement with the gasket; and the gasket comprises closed cell foam.

5. The gate valve assembly of claim 1 further comprising:

a gasket disposed within the frame assembly around the periphery of the opening;

the valve member having a surface for engagement with the gasket; and the gasket comprises elastomeric material.

6. The gate valve assembly of claim 1 further comprising:

a gasket disposed within the frame assembly around the periphery of the opening;

the valve member having a surface for engagement with the gasket; and the gasket comprises a trapezoidal cross section.

7. The gate valve assembly of claim 1 wherein the locking mechanism further comprises:

a body member having at least one portion pivotally attached with the frame assembly;

another portion of the body member having a hook extending therefrom for engagement with the valve member when the locking mechanism is in its first position; and biasing means for urging the locking mechanism to move from its second position to its first position.

8. The locking mechanism as defined in claim 7 wherein the biasing means further comprises:

a rod having one end pivotally attached with the body member and offset from the pivotal attachment of the body member with the frame assembly;

a portion of the rod slidably engaged with the frame assembly; and a spring disposed on the exterior of the rod with the spring positioned between a first shoulder on the rod and a second shoulder on the frame assembly to urge movement of the lock mechanism from its second position to its first position.

9. The gate valve assembly of claim 1 wherein the frame assembly further comprises:

an upper hopper portion having a plurality of generally flat surfaces extending inwardly to form the opening;

the opening having a generally rectangular configuration defined by adjacent ends of the plurality of surfaces forming the upper hopper portion;

a plurality of supporting members attached to the exterior of the upper hopper portion and extending therefrom;

a pair of tube members attached to the supporting members with the tube members extending longitudinally from the opening in the upper hopper portion;

a gasket disposed on the exterior of the upper hopper portion between the supporting members and the plurality of surfaces around the perimeter of the opening; and the valve member slidably carried on the pair of tube members.

10. The gate valve assembly of claim 1 wherein the operating assembly further comprises:

a shaft rotatably secured to the frame assembly with a pair of gears mounted on the shaft for rotation thereby;

a plurality of teeth formed on the exterior of each gear;

a pair of tracks formed in the lock striker disposed generally parallel with each other and aligned respectively with the pair of gears mounted on the shaft;

each track having a plurality of slots sized to receive the teeth from the respective gear;

a first stop carried by the valve member and a second stop carried by the valve member with the first stop and the second stop spaced longitudinally from each other; and the second stop limiting movement of the lock striker towards the locking mechanism and the first stop limiting movement of the lock striker away from the locking mechanism.

11. The gate valve assembly of claim 10 further comprising:

the valve member having a generally rectangular configuration with an upper surface and a lower surface;

a plurality of guides disposed on the lower surface of the valve member with a portion of the lock striker slidably disposed within the guides; and the second stop formed by a pair of blocks attached to the lower surface of the valve member with the blocks offset laterally from each other to allow a portion of the lock striker to extend longitudinally therebetween and to contact the lock mechanism.

12. The gate valve assembly of claim 1 wherein the valve member further comprises:

a generally rectangular plate having an upper surface and a lower surface;

one end of the rectangular plate having a lip with a tapered nose for engagement with the locking mechanism; and an opposite end of the rectangular plate folded in a generally c-shaped configuration.

13. The gate valve assembly of claim 1 further comprising:

the valve member having a generally rectangular configuration with an upper surface and a lower surface;

one end of the valve member having a configuration for engagement with the locking mechanism;

an opposite end of the valve member folded in a generally c-shaped configuration;

the frame assembly having an upper hopper portion with a generally rectangular opening extending therethrough;

a gasket-type seal disposed on the exterior of the upper hopper portion around the perimeter of the generally rectangular opening;

at least one set of ramps disposed respectively on the valve member and the frame assembly for positioning the valve member in contact with the gasket-type seal when the valve member is in its first position; and the c-shaped configuration on the opposite end of the valve member cooperating with the frame assembly to further enhance the material barrier formed between the gasket-type seal and the valve member when the gate valve assembly is in its first position.

14. The gate valve assembly of claim 1 wherein the valve member further comprises:

a generally rectangular plate having an upper surface and a lower surface;

one end of the rectangular plate having a lip with a tapered nose for engagement with the locking mechanism; and an opposite end of the rectangular plate having an angle iron welded transversely there across.

15. The gate valve assembly of claim 1 further comprising:

the valve member having a generally rectangular configuration with an upper surface and a lower surface;

one end of the valve member having a configuration for engagement with the locking mechanism;

an opposite end of the valve member having an angle iron welded transversely across the lower surface;

the frame assembly having an upper hopper portion with a generally rectangular opening extending therethrough;

a gasket-type seal disposed on the exterior of the upper hopper portion around the perimeter of the generally rectangular opening;

at least one set of ramps disposed respectively on the valve member and the frame assembly for positioning the valve member in contact with the gasket-type seal when the valve member is in its first position; and another pair of ramps carried on the frame assembly for cooperating with the opposite end of the valve member to further enhance the material barrier formed between the gasket-type seal and the valve member when the gate valve assembly is in its first position.

16. A gate valve and frame assembly having an elongated valve member with a generally rectangular configuration for controlling a discharge opening on a railway hopper car comprising:

an upper hopper portion having four slanted surfaces extending inwardly to form the discharge opening;

the discharge opening having a generally rectangular configuration defined in part by the inwardly slanted surfaces of the upper hopper portion and the generally rectangular discharge opening displaced vertically from the bottom of the railway hopper car;

a plurality of supporting members extending vertically from the upper hopper portion and spaced from the generally rectangular discharge opening;

a gasket disposed on the exterior of the upper hopper portion between the supporting members and the perimeter of the generally rectangular discharge opening;

a pair of tracks attached to and extending longitudinally from the supporting members;

the tracks disposed on opposite sides of the rectangular discharge opening in the upper hopper portion and aligned generally parallel with each other to allow longitudinal movement of the elongated valve member between a first position blocking the generally rectangular discharge opening and a second position allowing flow through the generally rectangular discharge opening;

at least one set of ramps disposed respectively on the elongated valve member and the frame assembly for positioning the elongated valve member in contact with the gasket; and the supporting members cooperating with each other to allow displacement of the elongated valve member vertically from the gasket as the elongated valve member moves longitudinally from its first position to its second position.

17. The gate valve and frame assembly of claim 16 further comprising:

a pair of hollow tubes attached with the supporting members and extending longitudinally therefrom; and each hollow tube having an upper surface to provide one of the pair of tracks which allow longitudinal movement of the elongated valve member relative to the rectangular discharge opening.

18. The gate valve and frame assembly of claim 17 wherein the hollow tubes further comprise a generally rectangular cross section.

19. The gate valve and frame assembly of claim 16 wherein the tracks further comprise a pair of angle irons attached to the supporting members on opposite sides of the rectangular discharge opening with each angle iron providing a surface to allow longitudinal movement of the elongated valve member between its first position and its second position.

20. The gate valve and frame assembly of claim 16 wherein the gasket further comprises:

a generally rectangular configuration with an opening formed therein having a perimeter larger than the perimeter of the discharge opening in the upper hopper portion;

each side of the gasket having a cross section with a bore formed therein; and a plurality of reinforcing members extending through the bores and conforming generally with the rectangular configuration of the gasket.

21. A gate valve assembly for mounting on a discharge opening of a railway hopper car comprising:

a frame assembly for mounting the gate valve assembly with the discharge opening;

the gate valve assembly having an elongated valve member slidably disposed within the frame assembly for movement between a first position blocking the discharge opening and a second position closing the discharge opening;

a shaft rotatably secured to the frame assembly with a pair of gears mounted on the shaft for rotation thereby;

a plurality of teeth formed on the exterior of each gear;

the elongated valve member having a generally rectangular configuration with an upper surface and a lower surface;

a lock striker slidably disposed on the lower surface of the elongated valve member;

a locking mechanism attached to the frame assembly having a first position blocking movement of the elongated valve member from its first position to its second position and the locking mechanism having a second position allowing movement of the elongated valve member from its first position to its second position;

a pair of tracks formed in the lock striker disposed generally parallel with each other and aligned respectively with the pair of gears mounted on the shaft;

each track having a plurality of slots to receive the teeth from the respective gear;

a first stop carried by the elongated valve member and a second stop carried by the elongated valve member with the first stop and the second stop longitudinally spaced from each other; and the second stop limiting movement of the lock striker towards the locking mechanism and the first stop limiting movement of the lock striker away from the locking mechanism.

22. The gate valve assembly of claim 21 further comprising:

a plurality of guides disposed on the lower surface of the elongated valve member with a portion of the lock striker slidably disposed within the guides;

the second stop formed by a pair of blocks disposed on the lower surface of the elongated valve member with the blocks offset laterally from each other to allow a portion of the lock striker to extend longitudinally therebetween; and one end of the lock striker having a tapered surface for engagement with and movement of the locking mechanism from its first position to its second position.

23. The gate valve assembly of claim 21 further comprising:

one end of the elongated valve member having a tapered nose for engagement with the locking mechanism;

the locking mechanism having a body pivotally attached to the frame assembly;

another portion of the body having a hook extending therefrom for engagement with the one end of the elongated valve member having the tapered nose when the locking mechanism is in its first position; and biasing means for urging the locking mechanism from its second position to its first position.

24. A railway hopper car comprising:

a plurality of hopper sections for carrying material with a discharge opening at the lower portion of each hopper section;

a plurality of frame assemblies for respectively mounting a gate valve assembly with each of the discharge openings;

an elongated valve member slidably disposed within each frame assembly for movement between a first, closed position blocking the flow of material from the respective discharge opening and a second, open position allowing material to flow from the respective discharge opening;

an operating assembly disposed on each frame assembly for longitudinally moving the respective elongated valve member between its first position and its second position;

a locking mechanism attached to each frame assembly having a first position which blocks movement of the respective elongated valve member from its first position to its second position and each locking mechanism having a second position which allows movement of the respective elongated valve member from its first position to its second position; and a lock striker slidably disposed on the elongated valve member to provide a portion of the operating assembly whereby the lock striker may be extended longitudinally from the elongated valve member to move the respective locking mechanism from its first position to its second position prior to the operating assembly moving the elongated valve member from its first position to its second position.

25. The railway hopper car of claim 24 wherein the elongated valve member further comprises:

a generally rectangular plate having a flat upper surface and a lower surface;

a plurality of guides disposed on the lower surface of the rectangular plate with a portion of the lock striker slidably disposed within the guides; and one end of the rectangular plate having a tapered nose for engagement with the locking mechanism.

26. The railway hopper car of claim 24 further comprising:

an elastomeric gasket-type seal disposed within a portion of each frame assembly around the periphery of the respective discharge opening;

the elongated valve member having a first, relatively flat upper surface for engagement with the elastomeric gasket-type seal;

at least one set of ramps disposed respectively on each elongated valve member and each frame assembly for positioning the upper surface of the respective elongated valve member in close contact with the elastomeric gasket-type seal when the elongated valve member is in its first position; and the ramps cooperating with each other to allow displacement of the upper surface of the respective elongated valve member vertically from the elastomeric gasket-type seal as the respective elongated valve member moves longitudinally from its first position to its second position.

27. The railway hopper car of claim 24 wherein each locking mechanism further comprises:

a body member having a pair of arms with one portion of each arm pivotally attached with the respective frame assembly;

another portion of the body member having a hook extending therefrom for engagement with the elongated valve member when the locking mechanism is in its first position; and biasing means for urging the locking mechanism to move from its second position to its first position.

28. The railway hopper car of claim 27 wherein each biasing means further comprises:

a pair of rods with each rod having one end pivotally attached with the respective body member and laterally offset from the pivotal attachment of the arms with the respective frame assembly;

a portion of each rod slidably engaged with the respective frame assembly; and a spring disposed on the exterior of each rod and position between a first shoulder on the respective rod and a second shoulder on the respective frame assembly to move the respective lock mechanism from its second position to its first position.

29. The railway hopper car of claim 24 wherein each frame assembly further comprises:

an upper hopper portion having four surfaces slanting generally inwardly from the respective discharge opening;

a generally rectangular opening defined by the four inwardly slanting surfaces of each upper hopper portion;

a plurality of supporting members attached to and extending vertically from each upper hopper portion;

a pair of hollow tube members respectively attached to the supporting members for each upper hopper portion with the hollow tube members extending longitudinally from the respective opening in each upper hopper portion;

a gasket disposed on the exterior of each upper hopper portion between the respective supporting members and the respective inwardly slanting surfaces around the perimeter of each rectangular opening; and each elongated valve member slidably carried on the respective pair of hollow tube members.

30. The railway hopper car of claim 24 wherein the operating assembly for each gate valve assembly further comprises:

a shaft rotatably secured to the respective frame assembly with a pair of gears mounted on each shaft for rotation thereby;

a plurality of teeth formed on the exterior of each gear;

a set of tracks formed in each lock striker with each set of tracks disposed generally parallel with each other and aligned with the respective pair of gears mounted on each shaft;

each track having a plurality of slots to receive the teeth from the respective gear;

a first stop carried by each elongated valve member and a second stop carried by each elongated valve member with the first stop and the second stop longitudinally offset respectively from each other; and each second stop limiting movement of the lock striker towards the respective locking mechanism and each first stop limiting movement of the respective lock striker away from the respective locking mechanism.

31. A method of controlling a gate valve assembly mounted on a discharge opening from a railway hopper car carrying material and the gate valve assembly having an elongated valve member with a first position for blocking the flow of material from the discharge opening and a second position allowing the material to flow from the discharge opening comprising the steps of:

providing a frame assembly for mounting the gate valve assembly with the discharge opening;

slidably disposing the elongated valve member within the frame assembly for movement between the first position and the second position;

moving the elongated valve member between its first position and its second position by an operating assembly secured to the frame assembly;

attaching a locking mechanism to the frame assembly with the locking mechanism having a first position blocking movement of the elongated valve member from its first position to its second position and the locking mechanism having a second position allowing longitudinal movement of the elongated valve member from its first position to its second position;

slidably attaching a lock striker with the elongated valve member to provide a portion of the operating assembly; and extending the lock striker longitudinally from the elongated valve member to move the locking mechanism from its first position to its second position prior to the operating assembly moving the valve member from its first position to its second position.

32. The method of controlling the gate valve assembly of claim 31 further comprising the steps of:

forming a material barrier between a gasket-type seal carried by the frame assembly and an upper surface of the elongated valve member when the elongated valve member is in its first position; and displacing the elongated valve member vertically from the gasket-type seal material during longitudinal movement of the elongated valve member from its first position to its second position.

33. The method of controlling the gate valve assembly of claim 31 further comprising the step of forming a material barrier between a gasket-type seal carried by the frame assembly and an upper surface of the elongated valve member by displacing the elongated valve member vertically toward the gasket-type seal material during longitudinal movement of the elongated valve member from its second position to its first position.

34. The method of controlling the gate valve assembly of claim 31 further comprising the step of trapping a lip formed on one end of the elongated valve member by a hook carried on the locking mechanism when the locking mechanism is in its first position and the railway hopper car is subjected to an impact force.

35. The method of controlling the gate valve assembly of claim 31 further comprising the steps of:

pivotally attaching the locking mechanism with the frame;

contacting the locking mechanism with a pair of tapered surfaces disposed on the lock striker while extending the lock striker longitudinally from the elongated valve member; and moving both the lock striker and the elongated valve member longitudinally with each other after the locking mechanism has moved to its second position.

36. A gasket for forming a material barrier around the perimeter of a discharge opening from a railway hopper car in cooperation with a gate valve assembly mounted on the discharge opening, comprising:

a generally rectangular configuration corresponding approximately with the perimeter of the discharge opening;

a generally trapezoidal cross section with a longitudinal bore formed in and extending along each side of the gasket;

each longitudinal bore having a generally circular cross section with a uniform inside diameter;

at least one reinforcing member disposed in each longitudinal bore;

each reinforcing member having a generally circular cross section with an outside diameter substantially equal to the inside diameter of the respective longitudinal bore; and a plurality of gasket retainers disposed in each side of the gasket for installing the gasket at a desired position relative to the discharge opening and the gate valve assembly.

* * * * *